299-13 SR
4/17/79 XR 4,149,604

United States Patent [19] [11] 4,149,604
Lockwood et al. [45] Apr. 17, 1979

[54] MINING EQUIPMENT

[75] Inventors: Peter Lockwood; Frederick Webster; Peter Clayton, all of Handsworth, England

[73] Assignee: Lockwood Bennett Limited, Sheffield, England

[21] Appl. No.: 848,360

[22] Filed: Nov. 3, 1977

[30] Foreign Application Priority Data

Nov. 6, 1976 [GB] United Kingdom ..... 46311/76

[51] Int. Cl.[2] ..... E21D 7/00
[52] U.S. Cl. ..... 175/57; 173/46; 175/315; 299/13; 299/18
[58] Field of Search ..... 173/46; 175/315, 57; 299/13, 18

[56] References Cited

U.S. PATENT DOCUMENTS 2,993,685 7/1961 Russeu ..... 175/315
3,999,805 12/1971 Lockwood ..... 299/66

*Primary Examiner*—William F. Pate, III
*Attorney, Agent, or Firm*—Lowe, King, Price & Becker

[57] ABSTRACT

A method of drilling shot firing holes in the face of a roadway or tunnel by means of a bucket loader on which is displaceably mounted a drilling mast which carries a slidable drill head, with power unit to displace the drill head with respect to the mast connected between the drill head and mast, comprises the steps of:

advancing the mast from a non-active, rearward position towards an active, forward position, by fixing the drill head with respect to the loader and activating the power unit;

fixing the position of the mast with respect to the loader and releasing the drill head and again activating the power unit to advance the drill head with respect to the mast, after drilling as required; and retracting th drill head by activating the power unit, either as a preparatory step for subsequent advance to drill further holes or alternatively for purposes of retracting the mast, after fixing the drill head in its retracted position with respect to the loader and releasing the mast and again activating the power unit.

A bucket loader suitable for carrying out the above method comprises at least one elongate drilling mast mounted on the loader and displaceable between active and non-active positions, the mast carrying a drill head displaceble therealong, means to releasably secure the mast with respect to the loader, to advance or retract the drill head, and means to releasably secure the drill head to the loader to advance or retract the mast.

10 Claims, 2 Drawing Figures

MINING EQUIPMENT

This invention relates to a method of drilling shot firing holes in the face of a mine roadway or tunnel and to mining or tunnelling equipment for use in carrying out such method and in particular to a bucket loader suitable for use, not only in driving a tunnel or roadway, but also for clearing or loading the debris resulting therefrom.

There are now employed in British coal mines, impact breakers for bringing down the ripping lip to advance roadways which are located, as usual, one at each end of a coal face. Such impact breakers work by a percussive action on the ripping lip, in contrast to machines provided for the same purpose, but employing one or more pick carrying rotary cutting heads, both these machine types being alternatives to the traditional drilling and shot firing. Known drilling rigs comprise basically an elongate mast, a drill head slidable along the mast by means of a power unit connected between the drill head and mast from a rearward position to a forward position as a drill rod secured in the drill head and rotated thereby is advanced into the face of the tunnel or roadway. Such rigs can be relatively small and hence manhandled into position, or relatively large being mounted on a crawler base conveniently carrying a plurality of drilling rigs.

Furthermore, it is known to employ a crawler mounted, hydraulically powered bucket loader to raise the debris from the floor of the roadway e.g. onto a conveyor to convey the debris into a pack hole, on the bucket of which is mounted the impact breaker unit, which remains on the bucket in use, during the loading.

However, when driving roadways through cross measures, it is not uncommon for rock formations to be encountered which cannot be broken down by the impact breaker unit one cannot avoid drilling and shot firing, and this usually entails retraction of the bucket loader while drilling equipment is manoeuvred into position.

According to a first aspect of the present invention, a method of drilling shot firing holes in the face of a roadway or tunnel by means of a bucket loader on which is displaceably mounted a drilling mast which carries a slidable drill head, with power unit to displace the drill head with respect to the mast connected between the drill head and mast, comprises the steps of:

advancing the mast from a non-active, rearward position towards an active, forward position, by fixing the drill head with respect to the loader and activating the power unit;

fixing the position of the mast with respect to the loader and releasing the drill head and again activating the power unit to advance the drill head with respect to the mast, after drilling as required; and retracting the drill head by activating the power unit, either as a preparatory step for subsequent advance to drill further holes or alternatively for purposes of retracting the mast, after fixing the drill head in its retracted position with respect to the loader and releasing the mast and again activating the power unit.

According to a second aspect of the present invention, a bucket loader for the combined driving of a tunnel or roadway and the loading of the resulting debris, comprises at least one elongate drilling mast mounted on the loader and displaceable between active and non-active positions, the mast carrying a drill head displaceable therealong, means to releasably secure the mast with respect to the loader, to advance or retract the drill head, and means to releasably secure the drill head to the loader to advance or retract the mast.

Thus the method and apparatus of the invention make use of the power unit conventionally provided to displace only the drill head with respect to the mast to displace additionally the mast with respect to the drill head by suitably locking or releasing the mast or drill head as required.

Thus, the non-active, rearward position of the mast may be a parked position in which the drilling mast is retracted, so as to present no obstruction to the movement required of the bucket during debris loading operations. In detail, to displace the mast from a parked, non-active position, the drill head is secured in position e.g. by means of a fixing pin or by engaging a swingable stop and the mast released e.g. by removal of a fixing pin. Thus the stop for instance serves to obstruct movement of the drill head along the mast while, the pin passes between the mast and a portion e.g. a boom of the loader. The power unit is then operated which, conventionally would only advance the drill head but instead advances the mast. Thereafter the mast is secured and the drill head released and the power unit again operated whereupon the drill head advances along the mast in conventional manner. A plurality of such steps may be necessary to advance the mast and drill head from the non-active to active position. When the active position is reached, the mast is in its most forward position, with the drill head located at the rear end of the mast with respect to the face of the tunnel or roadway and the usual drill rods are then inserted in the drill head one by one as drilling progresses and holes are drilled in conventional manner by advancing the drill head, during a drilling stroke, and retracting the drill head to receive the next drill rod.

Preferably, the mounting of the mast on the loader is via a support means carried by the loader, on which support means the mast seats. Such support means could be a slide/guide bracket(s) or rollers. Preferably a support means is also provided on the bucket e.g. in the form of a slide/guide bracket or roller.

The power unit may be a chain and sprocket arrangement and/or a double-acting hydraulic ram.

Preferably, the loader is of the articulated form described in U.S. Pat. No. 1,377,809, in which case the non-active rearward location of the mast would be alongside the boom and generally parallel thereto. This construction also provides the advantageous possibility of locating one drilling mast to each lateral side of the boom, so enabling two holes to be drilled simultaneously.

The invention thus provides a bucket loader which has a drilling capability obviating the need for any manhandling of the drilling means or the need for separate drilling equipment and the subsequent loss of drilling time while such equipment is brought to the face and set up.

The invention will now be further described, by way of example, with reference to the accompanying drawings, in which.

Figure 1:
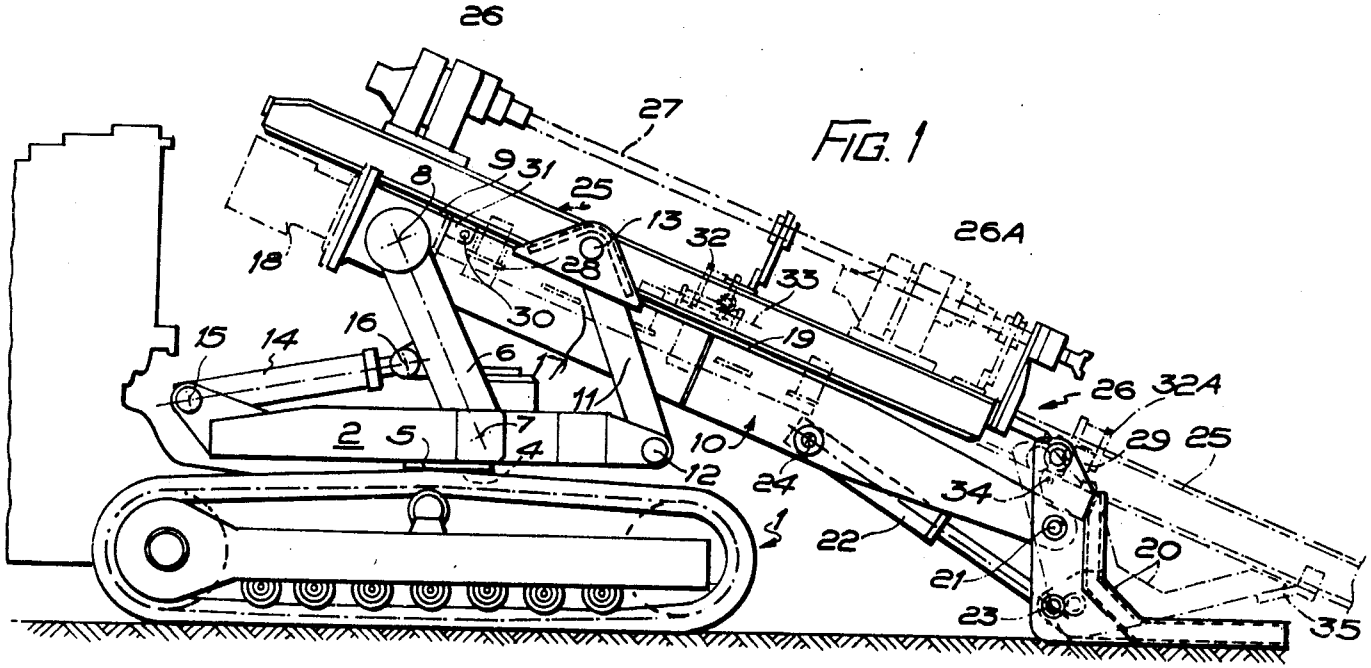
FIG. 1 is a side elevation of bucket loader in accordance with the invention.
Figure 2:
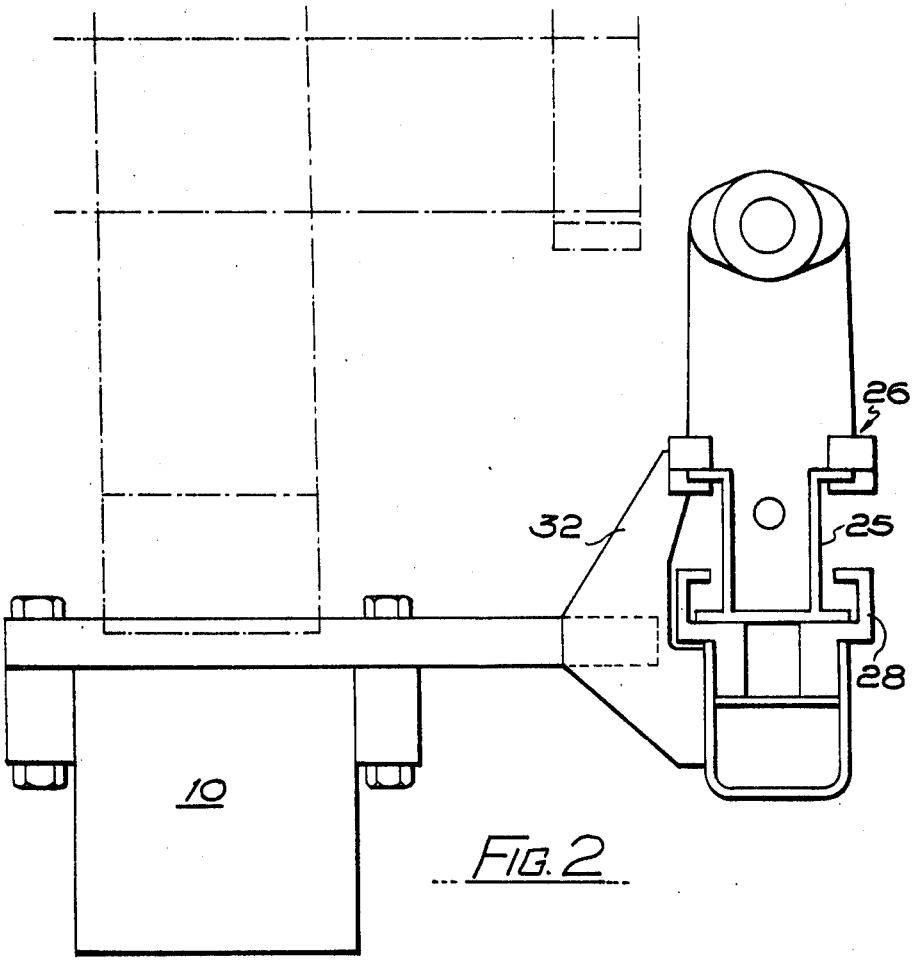
FIG. 2 is an end elevation of the bucket loader of FIG. 1.

In the drawings, the bucket loader comprises a support member 1, a turret 2 pivotally attached thereto and rotatable about an axis 4 by a pair of rams (not shown) connected to laterally extending arms 5 of the turret 2. Link means comprises firstly a pair of links 6 pivotally attached at pivot 7 one to each side of the turret 2, and at 8 to a rear portion 9 of a boom 10, and secondly, a pair of spaced apart rams 11 also pivotally attached at pivot 12 to the turret 2 and at 13 to the rear portion 9. The links means 6, 11 is rotatable about the pivot 7 and 12 by double-acting rams 14 pivotally attached at pivot 15 to the turret 2 and at pivot 16 to the link 6. The boom 10 has a longitudinal axis 17 and the rear portion 9 contains a part (not shown) capable of rotation through 360° about the longitudinal axis 17, the rotation being effected by a torque actuator 18 located transversely and at the end of the rear portion 9 remote from a front portion 19 carried by the rotatable part. To the end of the front portion 19 remote from the rear portion 9 is attached a mineral loading apparatus comprising a loading bucket 20, rotatable about a pivot point 21 extending orthogonally, with respect to the longitudinal axis 17 of the boom. The disposition of the loading bucket 20 with respect to the boom 10 is controlled by a double-acting hydraulic ram 22 pivotally secured at 23 to the bucket and 24 to the boom.

An impact breaker unit or other mineral detaching means may be mounted on the bucket to remove mineral from a ripping lip, roadway face, or tunnel face which is required to be advanced and is actuated with the bucket 20 displaced to a non-obstructed position. After detaching a quantity of mineral, the impact breaker unit etc. is retracted to a non-obstructing position and the bucket 20 employed to load detached mineral e.g. onto a conveyor.

On the boom 10 is mounted an elongate drilling mast 25 generally of "I" section, the mast carrying a slidable drill head 26, slidable along the mast 25 through a power unit comprising a double-acting hydraulic ram and a chain drive, drill rods of the drill head being indicated at 27 in chain dotted line. The drill mast 25 is slidably mounted on the boom 10 by support means comprising bearing brackets 28 carried by the boom 10, while a similar, forward bracket 29 is carried by the upper edge of the bucket 20. The drill mast 25 secured in its parked, rearward position on the boom is shown in full line in FIG. 1, with a pin 30 passing through a plate 31 extending downwardly from the mast 25 and entering an aperture on the boom. From the position shown in FIG. 1 when fluid is admitted to the advancing ram to advance the drill head 26, the head advances, in the conventional manner, to position 26A, because the mast 25 is fixed in position by the pin 30. When this has been effected a stop 32 is engaged by being pivotally displaced about its axis 33, the pin 30 removed and fluid admitted to the other side of the advancing ram. Initially, the drilling head is retracted slightly from the position shown at 26A until the stop 32 is reached, whereupon continued admission of fluid forces the drilling mast 25 forwards, until the limit stroke has been attained. This stepwise advancement sequence may be necessary several times dependent upon the stroke of the ram, to advance the drill mast a required distance from the boom. When the desired advance has been achieved, the boom is again locked in position by a pin 30, this time passing through aperture 34 in the bucket bracket 29, which also carries a pivotable stop 32A, while a clamp 35 with inturned lips is manually bolted to the forward end of the bucket.

What we claim is:

1. A method of drilling shot firing holes in the face of a roadway or tunnel by means of a bucket loader on which is displaceably mounted a drilling mast which carries a slidable drill head, with a power unit to displace said drill head with respect to said mast connected between said drill head and said mast, comprising the steps of:

advancing said mast from a non-active, rearward position towards an active, forward position, by fixing said drill head with respect to said bucket loader and activating said power unit;

fixing the position of said mast with respect to said loader and releasing said drill head and again activating said power unit to advance said drill head with respect to said mast to initiate drilling operations; and retracting said drill head by activating said power unit after drilling operations are completed.

2. A bucket loader for the combined driving of a tunnel or roadway and the loading of the resulting debris comprising at least one elongate drilling mast mounted on said loader and displaceable between active and non-active positions, a drill head carried by said mast and displaceable therealong, means to releasably secure said mast with respect to said loader to advance or retract said drill head, power means for displacing said drill head relative to said mast, and means to releasably secure said drill head to said loader to advance or retract said mast.

3. A bucket loader as claimed in claim 2, wherein said means for releasably securing the mast with respect to the loader comprises a swingable stop.

4. A bucket loader as claimed in claim 2, wherein said means for releasably securing said drill head to said loader comprises a removable fixing pin.

5. A bucket loader as claimed in claim 3, wherein said mounting of said mast on said loader is via a support means carried by said loader, on which support means said mast seats.

6. A bucket loader as claimed in claim 5, wherein said support means are spaced slide/guide brackets.

7. A bucket loader as claimed in claim 5, wherein a support means is also provided on said bucket.

8. A bucket loader as claimed in claim 7, wherein said support means on said bucket is in the form of a slide/-guide bracket.

9. A bucket loader as claimed in claim 3, wherein said power unit is a chain and sprocket and double-acting hydraulic ram arrangement.

10. A bucket loader as claimed in claim 3, wherein said bucket is carried by an articulated boom.

* * * * *